United States Patent [19]

Fachbach et al.

[11] 4,197,826

[45] Apr. 15, 1980

[54] INTERNAL COMBUSTION ENGINE HAVING A NOISE-SUPPRESSING ENCAPSULATION

[75] Inventors: Heinz Fachbach; Gerhard Thien; Karl Kirchweger, all of Graz, Austria

[73] Assignee: Hans List, Graz, Austria

[21] Appl. No.: 951,632

[22] Filed: Oct. 16, 1978

[30] Foreign Application Priority Data

Oct. 28, 1977 [AT] Austria ..... 7713/77

[51] Int. Cl.[2] ..... F02B 77/00; F01P 1/02

[52] U.S. Cl. ..... 123/198 E; 123/41.7; 181/204

[58] Field of Search ..... 123/198 E, 195 C, 195 S, 123/41.65, 41.7, 41.75; 181/204, 227, 228

[56] References Cited

U.S. PATENT DOCUMENTS

| | | | |
|---|---|---|---|
| 3,856,439 | 12/1974 | Moehrbach | 181/204 |
| 3,949,726 | 4/1976 | List | 123/41.79 |
| 3,951,114 | 4/1976 | Fachbach et al. | 181/204 |
| 3,964,462 | 6/1976 | Thien et al. | 123/198 E |
| 3,973,548 | 8/1976 | Celli | 123/195 C |
| 4,011,849 | 3/1977 | Latham | 123/198 E |
| 4,122,353 | 10/1978 | Noguchi | 181/204 |
| 4,149,512 | 4/1979 | Hatz | 123/198 E |

*Primary Examiner*—Ira S. Lazarus

*Attorney, Agent, or Firm*—Watson, Cole, Grindle & Watson

[57] ABSTRACT

An internal combustion engine having a noise-suppressing encapsulation, a cooling air blower to ventilate the encapsulation, at least one cooling air inlet opening and at least one cooling air outlet opening arranged in the encapsulation, and an exhaust pipe connected to the engine by means of at least one body-resonance-absorbing compensator located at least partially within the encapsulation. The compensator penetrates the encapsulation without touching it and in the region of penetration is arranged at least one plate-like absorption silencer substantially within a plane perpendicular to the compensator axis.

6 Claims, 7 Drawing Figures

INTERNAL COMBUSTION ENGINE HAVING A NOISE-SUPPRESSING ENCAPSULATION

BACKGROUND OF THE INVENTION

This invention relates to an internal combustion engine having a noise-suppressing encapsulation, a cooling air blower to ventilate the encapsulation, at least one cooling air inlet opening and at least one cooling air outlet opening arranged in the encapsulation, and an exhaust pipe connected to the engine by means of at least one body-resonance-absorbing compensator located at least partially within the encapsulation.

DESCRIPTION OF THE PRIOR ART

The design of the point of penetration of the exhaust pipe through the noise-suppressing encapsulation of an internal combustion engine is a difficult problem. On the one hand excessive heat flow from the exhaust system to the encapsulation walls and into the inside of the encapsulation has to be prevented and on the other hand transmission of body resonance to the encapsulation walls must be avoided.

A solution of this problem is known from the Austrian Patent Specification No. 301 957 wherein an absorbtion silencer is arranged at the point of penetration concentrically to the exhaust pipe a part of the encapsulation cooling air emerging through the silencer to the surrounding atmosphere. Another solution is described in Austrian Patent Specification No. 330 515 wherein a water-cooled member is arranged at the point of penetration of the exhaust pipe and is connected to the cooling circuit of the engine. The cooled member is connected to the exhaust manifold and to the exhaust pipe outside the encapsulation. This solution needs advantageously only little space, however, it is afflicted with the essential disadvantages of the necessity to carry off more heat by the cooling water of the engine and of higher costs. The afore-mentioned solution mainly has the disadvantage of occupying a relatively large space.

SUMMARY OF THE INVENTION

It is the aim of the invention to avoid the disadvantages of the known constructions. This can be effected in a simple and efficient way in that the compensator is arranged to penetrate the encapsulation without touching it and in that in the region of penetration at least one plate-like absorption silencer is arranged which surrounds the compensator thereby leaving a gap between itself and the compensator. The compensator is preferably of annular design and arranged substantially within a plane perpendicular to the compensator axis and comprises a cover attached to the exhaust pipe system and at least one wall partition which leaves a disc-like annular gap to the cover and is connected to the encapsulation, whereby the gap between the cover and the wall partition is at least partially lined with sound-absorbing material leaving a passage for the cooling air.

The main advantage of this type of construction is an especially simple and cost-saving design, simultaneously requiring a minimum of space. Due to the extension of the silencer along the whole length of the engine the silencer gap for the emerging cooling air can be kept very narrow, so that the acoustic effect of the silencer is improved. Very effective noise absorption is achieved despite relatively small overall dimensions. The cross sectional area for the emerging cooling air is — compared with that of tube-like absorption silencers — essentially larger, and this results in a lower emerging velocity of the cooling air, thus effecting further noise reduction. As a further advantage the simple assembling of the silencer and the exhaust pipe is to be noted.

According to another embodiment of the invention the absorption silencer comprises a pot-like stud secured to the encapsulation and enclosing the cover thereby forming an annular gap in the region of the outer diameter of the cover, the bottom of the pot-like stud is spaced away from the cover and has at least one aperture for the penetration of the exhaust pipe connected to the compensator, whereby the space between the bottom of the pot-like stud and the cover is lined with sound-absorbing material. This design enables doubling of the sound-absorbing surface without an increase of space requirement. Due to the labyrinth-like air guide an especially effective diminution of air-transmitted noise is obtained.

A further embodiment was proved to be very advantageous, wherein the cover secured to the exhaust pipe system is flexible and attached also to the encapsulation in the region of its outer rim, preferably by means of screws and interposed spacers. Due to this design it is possible to utilize a very flexible type of an effective body-resonance absorption and relatively soft body-resonance-absorbing compensator, because due to the arrangement of a further mounting facility for the exhaust pipe the compensator is relieved of any retaining forces. Thereby the bending flexibility of the cover prevents body-resonance from being transmitted to the encapsulation.

According to a further embodiment of the invention the compensator may be surrounded between the encapsulation wall and the connecting flange at the cylinder head by a stud secured to the encapsulation wall, whereby between the exhaust pipe connecting flange on the side of the cylinder head and the inner end of the stud is formed a narrow annular gap. Thus in the region of the exhaust pipe connection an improved cooling air guidance is obtained and by suitable dimensioning of the air gap at the cylinder-head-sided connection flange an undesired re-entry of air heated on the hot exhaust pipe parts after stopping the engine (standstill of the ventilation blower) into the inside of the encapsulation is avoided.

The invention is not limited to single-cylinder-engines. For multi-cylinder-engines it may be very advantageous to provide each cylinder with a compensator to connect the exhaust manifold located outside the encapsulation to the engine. This arrangement of the exhaust manifold has the further significant advantage of little heat radiation from the rest of the exhaust system parts still being inside the encapsulation (in the main the body-resonance-absorbing compensators). This advantage exists during normal engine operation as well as after stopping the engine. Therefore it may be possible to eliminate the usually utilized ventilation blower and parts of the ventilation means. The absorption silencer thereby enables air flow caused by convection. Moreover, heat radiation from the usually very thin-walled compensators is of relative short duration.

According to a further development of the invention, for multi-cylinder-engines, the exhaust manifold may be also located inside the encapsulation and directly secured to the cylinder head whereby the connection of the exhaust pipe to the exhaust manifold is made by one single compensator. All the afore-mentioned advantages, except that of less heat radiation inside the encapsulation, can be accomplished and only one single compensator to connect the exhaust pipe is necessary. This is not only cost-saving but also connected with high noise suppression due to one single penetration aperture.

DESCRIPTION OF THE DRAWINGS

The invention will be hereinafter more specifically explained with reference to several exemplary embodiments depicted in the accompanying drawings, wherein.

Parts which are not essential for the invention are only schematically shown or are not represented. The same parts have identical references in the various embodiments.

DESCRIPTION OF THE PREFERRED EMBODIMENTS

Figure 2:
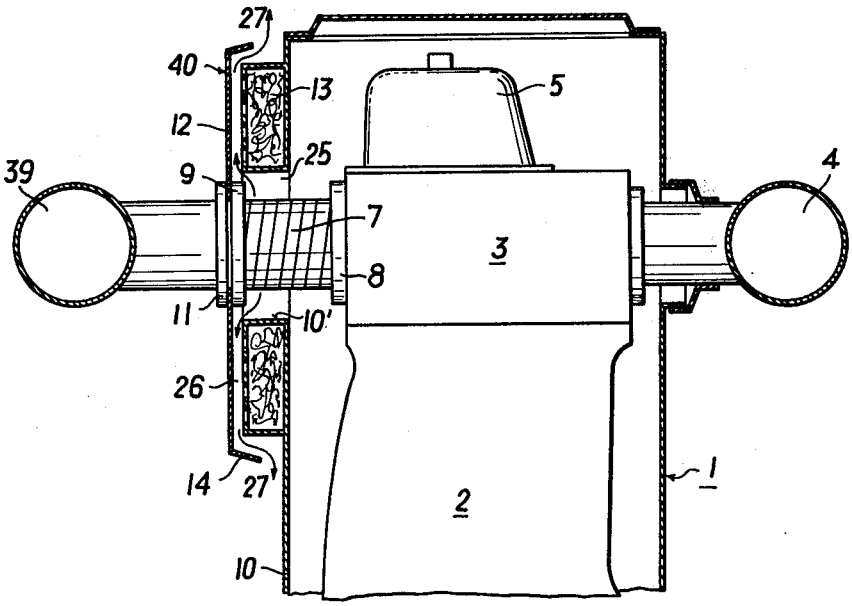
FIG. 2 is a partial cross section taken along line II—II of FIG. 1 on larger scale.

FIG. 2 shows—as an example for one cylinder, the exhaust pipe penetration through a noise-suppressing encapsulation 1 of a schematically represented internal combustion engine 2. The cylinder head is shown at 3, the intake manifold at 4, and the rocker arm cover at 5. An exhaust manifold 39 is connected to the cylinder head 3 by means of a body-resonance-absorbing compensator 7, which at both ends thereof provided with connection flanges 8, 9. A side wall 10 of the encapsulation 1 is spaced from the compensator 7 in the region of penetration of the latter. Between the outer connection flange 9 of the compensator 7 and a connection flange 11 of the exhaust manifold 39 there is arranged a cover 12 extending outwardly and covering the penetration point. The disc-like annular space formed between cover 12 and side wall 10 is lined with sound-absorbing material 13, thereby leaving open an also disc-like annular gap 26 to the cover 12. The sound-absorbing material 13 is held in its position by a cuff 10' of the side wall 10 arranged in the region of penetration of the compensator 7 and is thereby shielded against heat radiation from the exhaust pipe. The cover 12 extends over the region lined with sound-absorbing material and is on its outer rim bent towards the encapsulation 1. The cover 12 and the part of the side wall 10 provided with sound-absorbing material 13 form together an absorption silencer 40 for the air-transmitted sound escaping together with the emerging cooling air.

Figure 1:
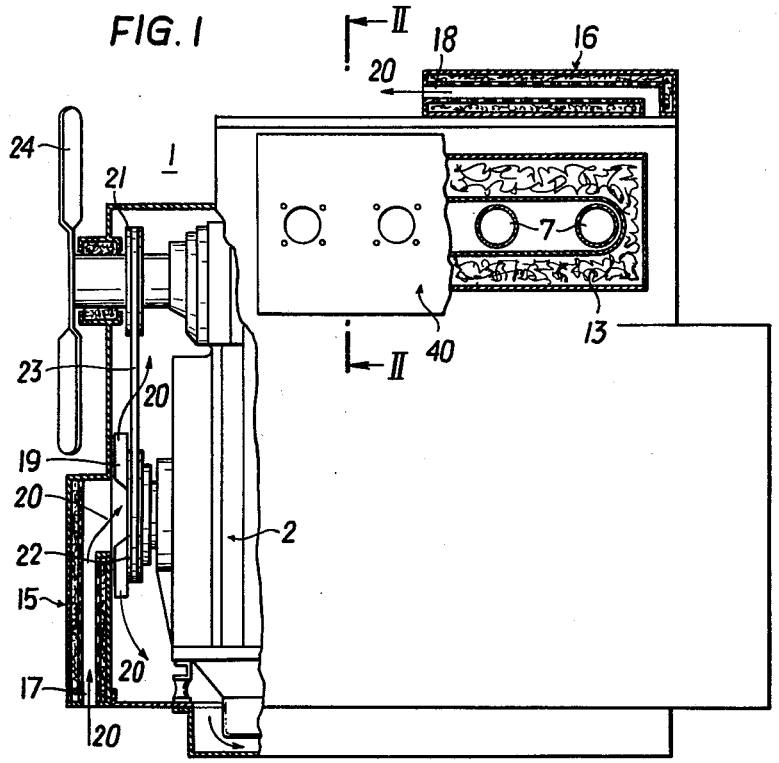
FIG. 1 is a longitudinal view of a multi-cylinder-engine according to the invention, the encapsulation shown partly in section and with the exhaust manifold taken off.

As shown in FIG. 1 the encapsulation 1 of the internal combustion engine 2 is provided with at least one inlet opening 17 and one outlet opening 18 for the cooling air—indicated by arrows 20—forced through the encapsulation by a blower 19. The air inlet and outlet openings 17, 18 are respectively provided with silencers 15, 16. The blower 19 is preferably arranged inside the encapsulation 1 and is driven from the engine 2 by means of V-belt pulleys 21, 22 and a V-belt 23. However, other driving constructions are possible, and the blower 19 may be also arranged outside the encapsulation 1. The main part of the cooling air emerges through the outlet opening 18 to the surrounding atmosphere. A smaller part flows through a gap 25 at the compensator penetration point and the disc-like annular gap 26 between cover 12 and sound-absorbing material 13 into the surrounding atmosphere, as indicated by arrow 27. The compensator 7 is thereby cooled, and escape of air-transmitted sound together with the emerging cooling air is prevented by the absorption silencer formed by the cover 12 and the sound-absorbing material 13.

Figure 3:
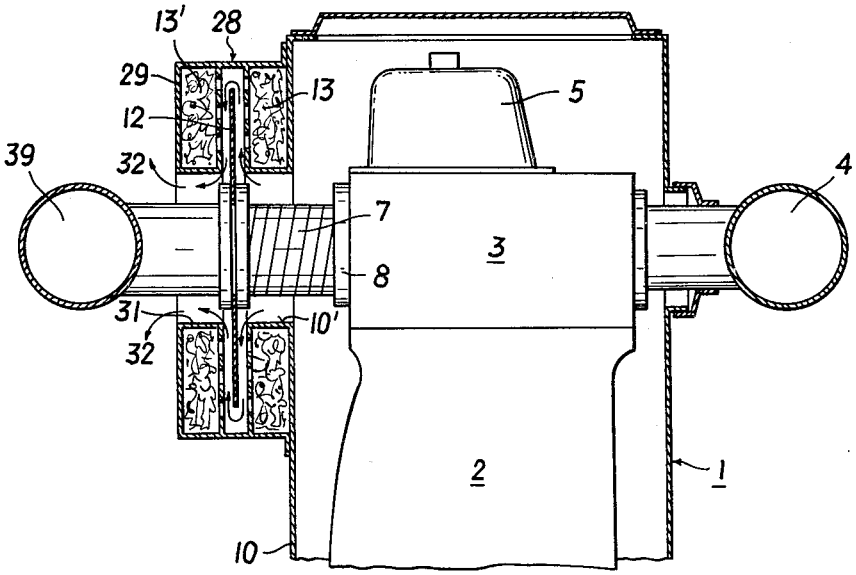
FIGS. 3 to 5 show further embodiments in partial cross section according to FIG. 2, and FIGS. 6 and 7 each show one embodiment of a multi-cylinder-engine on a smaller scale.

FIG. 3 represents an embodiment wherein the cover 12 and the sound-absorbing material 13 on the side wall 10 of the encapsulation 1 are surrounded by a pot-like stud 28. For multi-cylinder-engines this stud is of oblong shape and for single-cylinder-engines is preferably of circular shape. The bottom 29 of the stud 28 is provided with apertures for the penetration of the exhaust manifold 39, and a retraction 31 is arranged there which holds the sound-absorbing material 13' applied to the inner side of the bottom 29 in its position and forms a shield against heat radiation from the exhaust pipe. On the outer rim of the cover 12 a passage is formed between the cover 12 and the pot-like stud 28, so that the exhaust system parts 39, the compensators 7, the cover 12, and the stud 28 with the sound-absorbing linings 13, forms 13' a labyrinth for the emerging cooling air—arrows 32—which enables a very effective suppression of air-transmitted sound.

Figure 4:
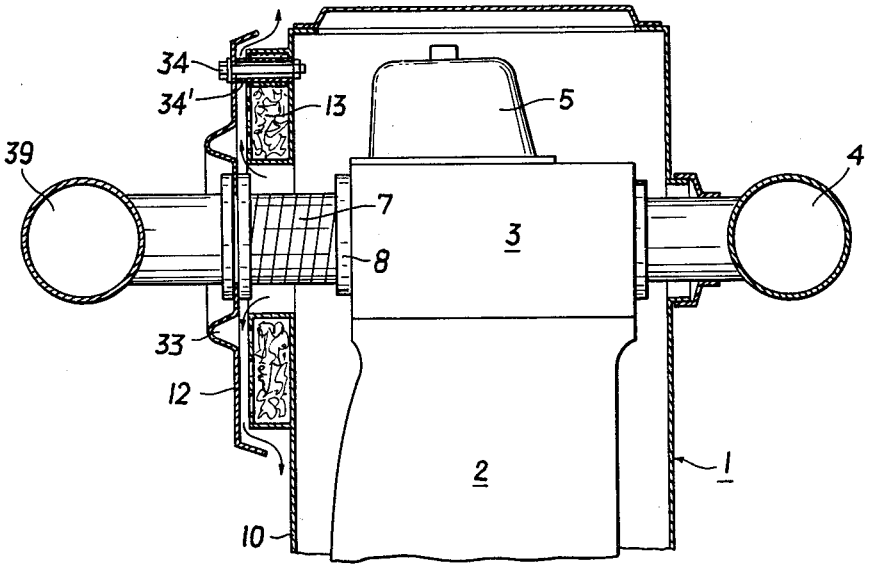

The embodiment depicted in FIG. 4 is similar to that of FIG. 1. The cover 12 is provided with an annular corrugation 33 and has therefore a certain degree of bending flexibility. This enables the cover 12 to be also secured at its outer rim to the side wall 10 of the encapsulation 1 by means of screws 34 and interposed spacers 34'. Thus the body-resonance-absorbing compensators 7 are relieved of retaining forces whereby the transmission of body resonance simultaneously is avoided due to the flexible design of the cover 12.

Figure 5:
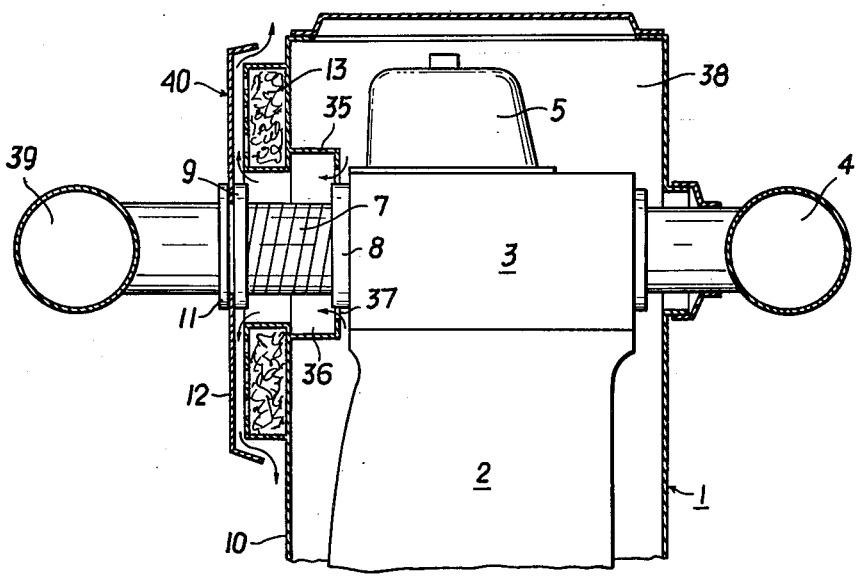

FIG. 5 shows the covering of the hot exhaust pipe connection inside the encapsulation 1 by means of a stud 35 surrounding the exhaust pipe, and this construction is also to the afore-mentioned embodiments. The stud 35 secured to the side wall 10 forms an exhaust pipe chamber 36, which prevents air heated by the hot exhaust system parts after stopping the engine (standstill of the ventilation blower) from entering into the inside 38 of the encapsulation 1 due to the relative narrow gap 37 between the cylinder-head-sided connection flange 8 and the inner end of the stud 35.

Figure 6:
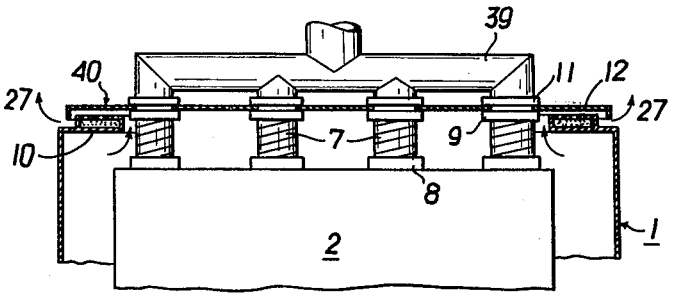

FIG. 6 shows an embodiment with an exhaust manifold 39 located totally outside the encapsulation 1. In this embodiment to each exhaust duct is connected a body-resonance-absorbing compensator 7 and the cover 12 is mounted between the connection flanges 9 and 11. All afore-described embodiments according to the invention, except that of FIG. 7, are capable of being arranged with an exhaust manifold 39 similarly as in FIG. 6.

Figure 7:
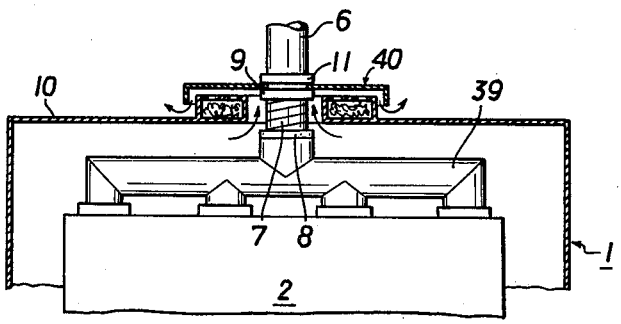

FIG. 7 shows the penetration of the exhaust pipe through the encapsulation of a multi-cylinder-engine with the exhaust manifold 39 located inside the encapsulation 1. The exhaust pipe 6 is connected to the manifold 39 by means of one single body-resonance-absorbing compensator 7 and flanges 8, 9, 11. The design of the absorption silencer 40 corresponds to that depicted in FIG. 1, however, also the other constructions are applicable.

We claim:

1. An internal combustion engine having a spaced noise-suppressing encapsulation, a cooling air blower for ventilating the encalsulation, at least one cooling air inlet opening and at least one cooling air outlet opening arranged in the encapsulation, and an exhaust pipe connected to the engine by means of at least one body-resonance-absorbing compensator located at least partially within the encapsulation, wherein said compensator penetrates said encapsulation, without touching it, and wherein in the region of penetration at least one plate-like absorption silencer is arranged, said silencer surrounding the compensator thereby leaving a gap between itself and the compensator and being of annular design and arranged substantially within a plane perpendicular to the compensator axis, the silencer comprising a cover attached to the exhaust pipe and at least one wall partition, said cover and said wall partition defining a disc-like first annular gap therebetween, said gap being in communication with the interior of the encapsulation, the gap between the cover and the wall partition being at least partially lined with sound absorbing-material leaving a passage for the cooling air.

2. An internal combustion engine according to claim 1, wherein the absorption silencer comprises a pot-like stud secured to the encapsulation and enclosing the cover thereby forming a second annular gap in the region of the outer diameter of the cover, the bottom of said pot-like stud being spaced away from the cover and having at least one aperture for the penetration of the exhaust pipe connected to the compensator, the space between the cover and the wall portion and between the bottom of the pot-like stud and the cover being lined with sound-absorbing material.

3. An internal combustion engine according to claim 1, wherein the cover secured to the exhaust pipe is flexible and is attached also to the encapsulation in the region of its outer rim by means of screws and interposed spacers.

4. An internal combustion engine according to claim 1, wherein the compensator is surrounded between the encapsulation wall and an exhaust pipe connecting flange at the cylinder head by a stud secured to the encapsulation wall, a narrow third annular gap being formed between the exhaust pipe connecting flange on the side of the cylinder head and the inner end of the stud.

5. An internal combustion engine according to claim 1, of the multi-cylinder-engine type, wherein each cylinder is provided with a compensator for connecting an exhaust manifold located outside the encapsulation to the engine.

6. An internal combustion engine according to claim 1, of the multi-cylinder-engine type, including an exhaust manifold being located inside the encapsulation and directly secured to the cylinder head, the connection of the exhaust pipe to the exhaust manifold being made by one single compensator.

* * * * *